US005692060A

United States Patent [19]

Wickstrom

[11] Patent Number: 5,692,060

[45] Date of Patent: Nov. 25, 1997

[54] UNIDIRECTIONAL MICROPHONE

[75] Inventor: Timothy K. Wickstrom, Elk Grove Village, Ill.

[73] Assignee: Knowles Electronics, Inc., Itasca, Ill.

[21] Appl. No.: 431,763

[22] Filed: May 1, 1995

[51] Int. Cl.[6] ..... H04R 25/00

[52] U.S. Cl. ..... 381/169; 381/168; 379/433

[58] Field of Search ..... 381/155, 168, 381/169, 188, 194, 195, 199, 205, 68–69.2, 68.3, 68.6; 181/171, 172; 379/430, 433, 428

[56] References Cited

U.S. PATENT DOCUMENTS

| | | | |
|---|---|---|---|
| 2,238,741 | 4/1941 | Lauffer | 179/115.5 |
| 2,527,540 | 10/1950 | Gayford | 381/170 |
| 3,293,378 | 12/1966 | Heppner | 381/194 |
| 3,536,862 | 10/1970 | Weingartner | 381/155 |
| 3,536,863 | 10/1970 | Schenkel | 179/121 |
| 3,553,392 | 1/1971 | Liebscher | 381/152 |
| 3,585,317 | 6/1971 | Dvorsky | 179/121 D |
| 3,653,625 | 4/1972 | Plice | 248/358 |
| 3,715,500 | 2/1973 | Sessler | 179/121 |
| 3,793,489 | 2/1974 | Sank | 179/121 D |
| 4,067,653 | 1/1978 | Fletcher et al. | 356/204 |
| 4,151,378 | 4/1979 | Watson | 179/111 |
| 4,369,857 | 1/1983 | Frazer et al. | 181/187 |
| 4,408,679 | 10/1983 | Littrell | 181/243 |
| 4,528,426 | 7/1985 | Fatovic et al. | 179/121 |
| 4,615,411 | 10/1986 | Breitscheidel et al. | 181/224 |
| 4,768,614 | 9/1988 | Case | 381/155 |
| 4,862,507 | 8/1989 | Woodard | 381/168 |
| 4,887,693 | 12/1989 | Plice | 381/183 |
| 5,010,771 | 4/1991 | Bruce | 73/861 |
| 5,208,867 | 5/1993 | Stites | 381/169 |
| 5,208,868 | 5/1993 | Sapiejewski | 381/187 |
| 5,226,076 | 7/1993 | Baumhauer, Jr. et al. | 381/155 |
| 5,282,245 | 1/1994 | Anderson | 381/169 |
| 5,327,506 | 7/1994 | Stites | 381/169 |
| 5,333,204 | 7/1994 | Hamada et al. | 381/158 |
| 5,338,768 | 8/1994 | Boer et al. | 521/164 |
| 5,511,130 | 4/1996 | Bartlett et al. | 381/154 |
| 5,526,433 | 6/1996 | Zakarauskas et al. | 381/92 |

OTHER PUBLICATIONS

Elmer V. Carlson and Mead C. Killion, "Subminiature Directional Microphones." *Journal of the Audio Engineering Society* (Sep. 1973), 92–96.

Electronic Response Shaping of Directional Microphones, *Knowles Technical Bulletin TB16*.

EB Directional Hearing Aid Microphone Application Notes, Knowles Technical Bulletin TB21.

*Primary Examiner*—Curtis Kuntz
*Assistant Examiner*—Rexford N. Barnie
*Attorney, Agent, or Firm*—Wallenstein & Wagner, Ltd.

[57] ABSTRACT

A unidirectional microphone assembly for receiving sound within a range of sound frequencies is disclosed. The microphone assembly comprises a housing formed of a sound absorbing material. The housing has an outer surface, and a bore extending inwardly along a bore axis from the outer surface to form a chamber within the housing. The microphone assembly further comprises a directional microphone having an axis of maximum reception. The microphone is disposed within the chamber and positioned with its axis of maximum reception directed outwardly substantially along the bore axis.

35 Claims, 2 Drawing Sheets

UNIDIRECTIONAL MICROPHONE

TECHNICAL FIELD

The present invention relates to microphones and, more particularly, to a hands-free, unidirectional microphone assembly, such as for use with a computer voice input system.

BACKGROUND PRIOR ART

Directional microphones to receive a maximum amount of desired signal from a desired direction, while rejecting background noise, are generally well known in the art. Examples include cardioid-type microphones, such as cardioid, hyper-cardioid and super-cardioid microphones. However, such microphones still have some sensitivity to off-axis noise.

The present invention is provided to solve these and other problems.

SUMMARY OF THE INVENTION

It is an object of the present invention to provide a unidirectional microphone assembly for receiving sound within a range of sound frequencies.

In accordance with the invention, the microphone assembly comprises a housing formed of a sound absorbing material. The housing has an outer surface, and a bore extending inwardly along a bore axis from the outer surface to form a chamber within the housing. The microphone assembly further comprises a directional microphone having an axis of maximum reception. The microphone is disposed within the chamber and positioned with its axis of maximum reception directed outwardly substantially along the bore axis.

It is contemplated that the bore is generally tapered from a larger outer diameter to a smaller inner diameter.

It is further contemplated that the housing is generally cubic or spherical, and formed of a closed cell acting polyurethane foam.

It is still further contemplated that the microphone is a cardioid type microphone, such as a super cardioid microphone, a cardioid microphone, or a hypercardioid microphone.

Other features and advantages of the invention will be apparent from the following specification taken in conjunction with the following drawings.

DETAILED DESCRIPTION

Figure 1:
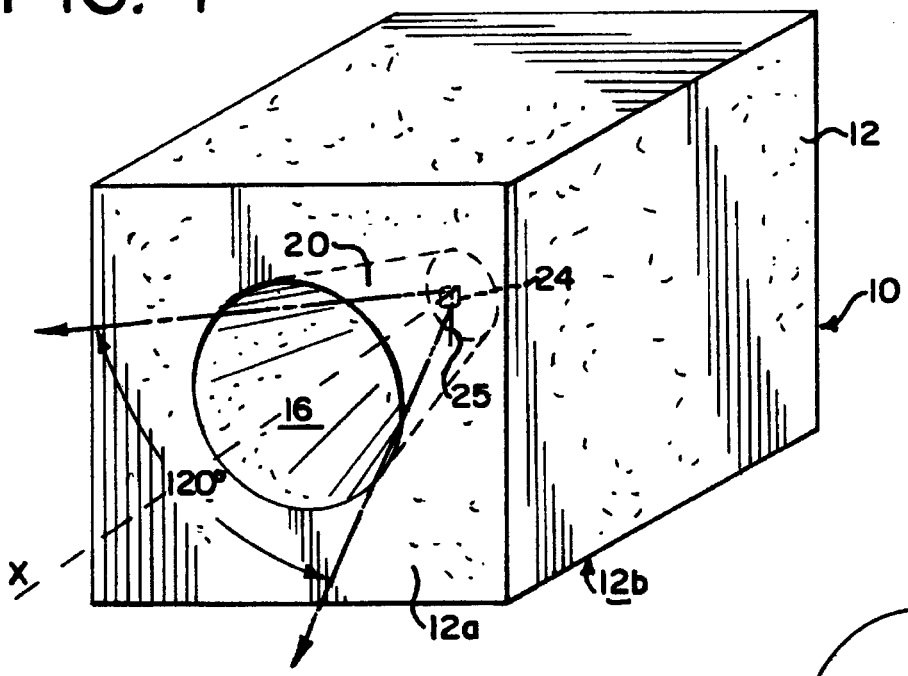
FIG. 1 is a perspective view of one embodiment of a microphone assembly according to the present invention.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

A unidirectional microphone assembly 10 for receiving sound within a range of sound frequencies is illustrated in FIG. 1. The present invention was developed for hands free and headset free use as a voice input system for a computer, though other uses of the microphone assembly are contemplated without departing from the spirit and scope of the invention. In situations, such as for example in an office environment, there is much background noise, and it is desired to have a microphone which will reject as much of the background noise as possible, to permit the computer to more easily and accurately recognize the voice input.

The microphone assembly 10 comprises a housing 12 formed of a sound absorbing material, such as a 100 pores per inch polyurethane foam, as supplied by Olsen Audio of Scottsdale, Ariz. The housing 12 has a face surface 12*a*, and a base surface 12*b*. A bore 16 extends inwardly along a bore axis "x" from the face surface 12*a*, terminating generally centrally within the housing 12, to form a chamber 20 within the housing 12. The microphone assembly 10 further includes a directional microphone 24 having an axis of maximum reception. In the preferred embodiment, the microphone 24 is a model NR-3163 super cardioid microphone, sold by Knowles Electronics, Inc., of Itasca, Ill. USA, the assignee of this application. Alternatively, the microphone 24 could be a cardioid microphone. As discussed in Knowles's Technical Bulletin No. TB-21, "EB Directional Hearing Aid Microphone Application Notes, although the cardioid microphone had a slightly greater 3 dB down pick-up arc (131°) than the super cardioid microphone (115°), the super cardioid microphone had greater random noise cancellation than the cardioid microphone. Still further, the microphone could be a hyper cardioid microphone.

Figure 2:
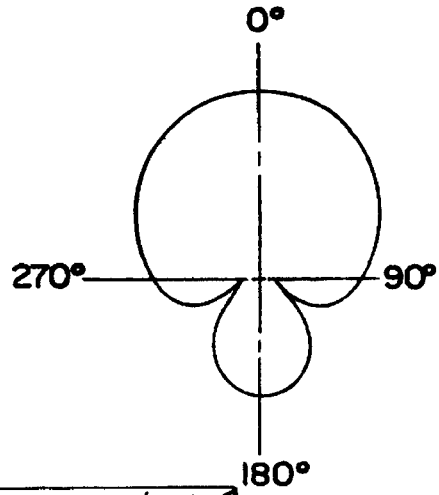
FIG. 2 is a polar response pattern for a typical super cardioid microphone, as utilized in the present invention.

The axis of maximum reception is shown in FIG. 2 as 0°. The microphone 24 is fixedly disposed within, and slightly spaced from the rear of, the chamber 20, on a post 25 embedded in the housing. The microphone 24 is positioned with its axis of maximum reception directed outwardly substantially along the bore axis.

Figure 3:
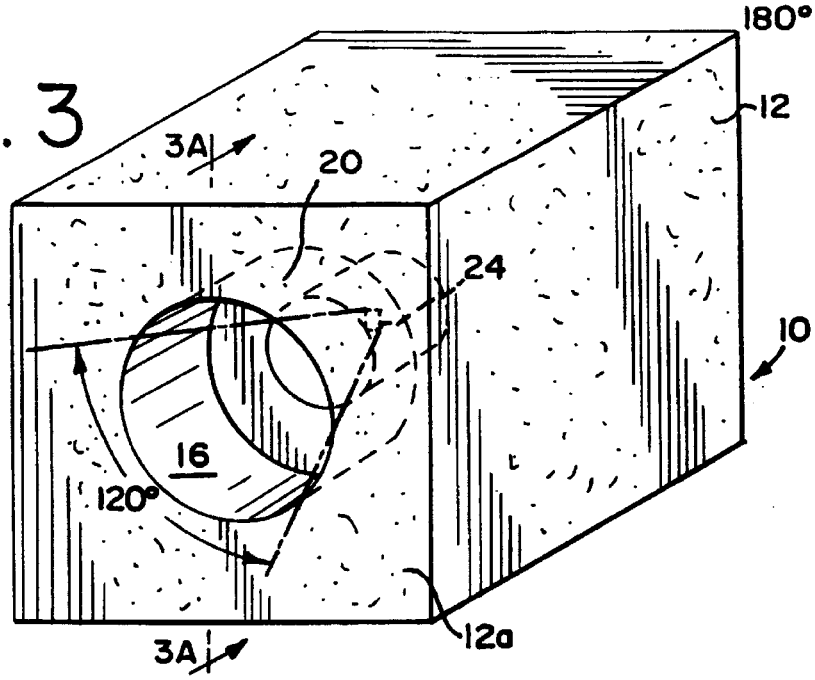
FIG. 3 is a perspective view of a second embodiment of a microphone assembly according to the present invention.
Figure 3A:
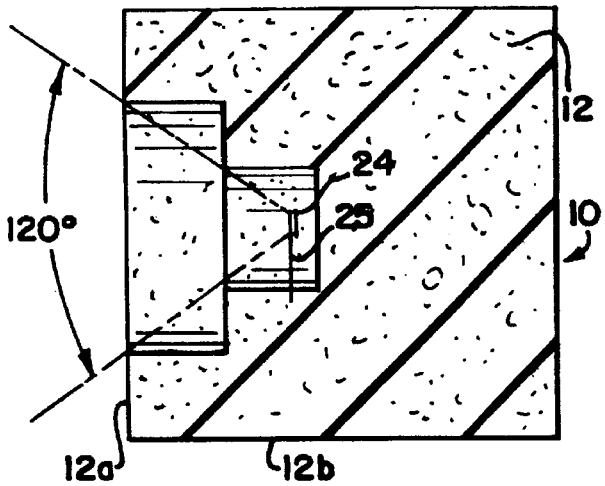

The bore 16 is generally tapered from a larger outer diameter to a smaller inner diameter. The taper is frustoconical at an angle sufficient to provide a clear path of 120° outwardly from the microphone. The 120° clear path closely matches the 115° pick-up arc of the model NR microphone. Alternatively, the taper can be stepped, as is the second embodiment illustrated in FIG. 3. It has been found that the stepped configuration of the second embodiment is easier to manufacture than the frustoconical configuration of the first embodiment, though the reception characteristics of the second embodiment are believed to be not as good as those of the first embodiment. In either event, the taper should be sufficient to provide a clear path of 120° outwardly from the microphone. Accordingly, the tapers shown in the Figures form an angle of substantially 120°, which is considered sufficient to provide an unimpeded path for desired sound, yet block undesired background noise.

The housing 12 of the microphone assembly 10 of the first and second embodiment is generally cubic. The microphone assembly 10 is intended to receive sound in the range of 3 kHz to 10 kHz. In order to provide sufficient noise reduction in this range of frequencies, it is desired that the housing thickness be at least ¼ of the maximum wavelength, which thickness provides approximately a 3 dB reduction in noise. This thickness corresponds to approximately one (1") inch. Accordingly, the housing 12 should have dimensions sufficient to provide at least 1" of housing material around the microphone 24.

The base surface 12b conveniently provides a resting surface for the microphone assembly 10, such as to rest the microphone assembly 10 on a computer monitor, not shown.

Figure 4:
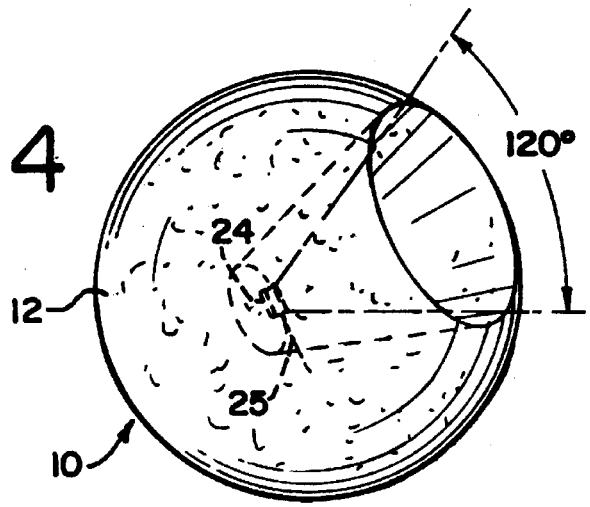
FIG. 4 is a perspective view of a third embodiment of a microphone assembly according to the present invention.

Alternatively, the housing 12 can be generally spherical, as illustrated in FIG. 4. In such case a conventional stand, not shown, would likely be required. As with the cubic design, the housing should have a thickness sufficient to provide at least 1" of housing material around the microphone.

Figure 5:
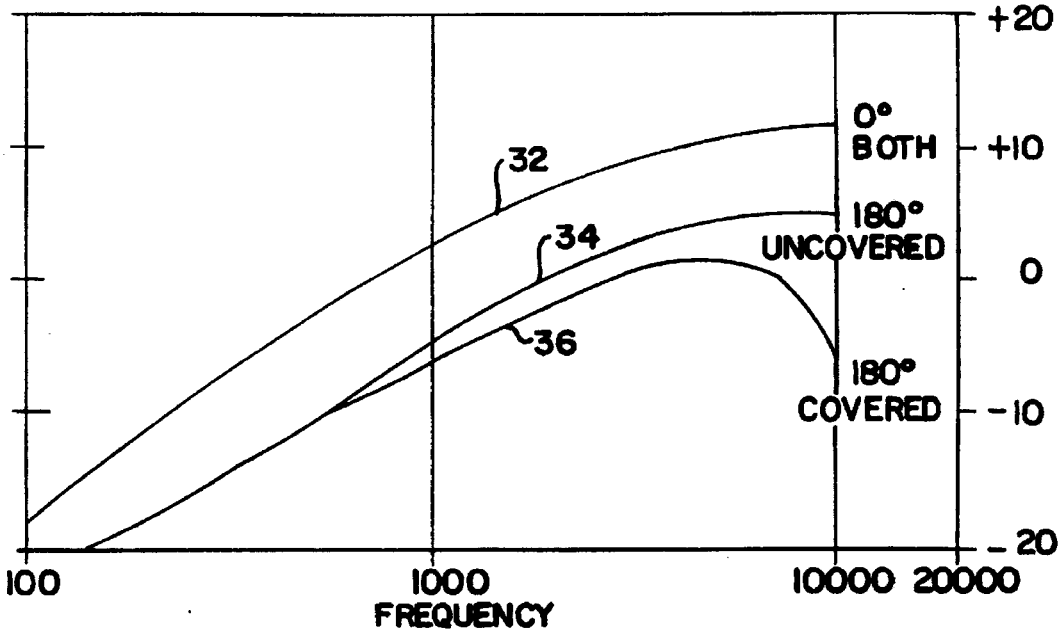
FIG. 5 is a logarithmic graph of three frequency response curves of various microphone assembly configurations.

A logarithmic graph of three frequency response curves 32, 34 and 36, of the second embodiment of the microphone assembly 10 is illustrated in FIG. 5. The first curve 32 is the response of both the NR microphone alone, as well as of the NR microphone contained in the housing 12. The curves are the same, illustrating that the housing 12 has no effect on the microphone's reception at 0°. The second curve 34 is the response of the NR microphone alone, and the third curve 36 is the response of the NR microphone contained in the housing 12, both second and third curves taken at 180°. As can be seen, there is a significant reduction in the 180° reception due to the housing 12, especially at the higher frequencies.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A unidirectional microphone assembly for receiving sound within a range of sound frequencies, the microphone assembly comprising:

a housing formed of a sound absorbing material, said housing having an outer surface, and a bore extending inwardly along a bore axis from said outer surface to form a chamber within said housing; and a directional microphone having an axis of maximum reception, said microphone disposed within said chamber and positioned with its axis of maximum reception directed outwardly substantially along said bore axis.

2. The microphone assembly of claim 1 wherein said bore is generally tapered from a larger outer diameter to a smaller inner diameter.

3. The microphone assembly of claim 2 wherein said taper is frustoconical.

4. The microphone assembly of claim 2 wherein said taper is stepped.

5. The microphone assembly of claim 1 wherein said taper forms an angle of substantially 120° relative to said microphone.

6. The microphone assembly of claim 1 wherein said housing is generally cubic.

7. The microphone assembly of claim 1 wherein said housing is generally spherical.

8. The microphone assembly of claim 1 wherein said housing material is polyurethane foam.

9. The microphone assembly of claim 1 wherein said housing material is a closed cell polyurethane foam.

10. The microphone assembly of claim 1 wherein said housing material is a dense, closed cell polyurethane foam.

11. The microphone assembly of claim 10 wherein said foam has a porosity of 100 pores per inch.

12. The microphone assembly of claim 1 wherein said microphone is a super cardioid microphone.

13. The microphone assembly of claim 1 wherein said microphone is a cardioid microphone.

14. The microphone assembly of claim 1 wherein said microphone is a hypercardioid microphone.

15. The microphone assembly of claim 1 wherein said housing has a thickness of at least ¼ wavelength of the frequencies within said range of frequencies.

16. A unidirectional microphone assembly for receiving sound within a range of sound frequencies, the microphone assembly comprising:

a housing formed exclusively of a closed cell, polyurethane foam, said housing having an outer surface, and a tapered bore extending inwardly along a bore axis from said outer surface to form a chamber within said housing; and a cardioid-type directional microphone having an axis of maximum reception, said microphone disposed within said chamber and positioned with its axis of maximum reception directed outwardly substantially along said bore axis.

17. The microphone assembly of claim 16 wherein said taper is frustoconical.

18. The microphone assembly of claim 16 wherein said taper is stepped.

19. The microphone assembly of claim 16 wherein said taper forms an angle of substantially 120° relative to said microphone.

20. The microphone assembly of claim 16 wherein said housing is generally cubic.

21. The microphone assembly of claim 16 wherein said housing is generally spherical.

22. The microphone assembly of claim 16 wherein said foam has a porosity of 100 pores per inch.

23. The microphone assembly of claim 16 wherein said microphone is a super cardioid microphone.

24. The microphone assembly of claim 16 wherein said microphone is a hypercardioid microphone.

25. The microphone assembly of claim 16 wherein said housing has a thickness of a approximately ¼0 wavelength of the frequencies within said range of frequencies.

26. A unidirectional microphone assembly for receiving sound within a range of sound frequencies, the microphone assembly comprising:

a generally cubic housing formed exclusively of a closed cell, polyurethane foam, said housing having an outer surface, and a tapered bore extending inwardly along a bore axis from said outer surface to form a chamber within said housing; and a cardioid-type directional microphone having an axis of maximum reception, said microphone disposed within said chamber and positioned with its axis of maximum reception directed outwardly substantially along said bore axis.

27. The microphone assembly of claim 26 wherein said taper is frustoconical.

28. The microphone assembly of claim 26 wherein said taper is stepped.

29. The microphone assembly of claim 26 wherein said taper forms an angle of substantially 120° relative to said microphone.

30. The microphone assembly of claim 26 wherein said foam has a porosity of 100 pores per inch.

31. The microphone assembly of claim 26 wherein said microphone is a super cardioid microphone.

32. The microphone assembly of claim 26 wherein said microphone is a hypercardioid microphone.

33. The microphone assembly of claim 26 wherein said housing has a thickness of a approximately ¼ wavelength of the frequencies within said range of frequencies.

34. A unidirectional microphone assembly for receiving sound within a range of sound frequencies, the microphone assembly comprising:

a generally cubic housing formed exclusively of a closed cell polyurethane foam, said housing having a thickness of at least ¼ wavelength of the frequencies within said range of frequencies, said housing having an outer surface, and a frustoconically tapered bore extending inwardly along a bore axis at an angle of substantially 120° relative to said microphone, from said outer surface to form a chamber within said housing; and a super-cardioid-type directional microphone having an axis of maximum reception, said microphone disposed within said chamber and positioned with its axis of maximum reception directed outwardly substantially along said bore axis.

35. The microphone assembly of claim 34 wherein said foam has a porosity of 100 pores per inch.

* * * * *